US008185999B2

(12) United States Patent
Boyd et al.

(10) Patent No.: US 8,185,999 B2
(45) Date of Patent: May 29, 2012

(54) ORAL CARE IMPLEMENT HAVING TISSUE CLEANING ELEMENTS WITH DIRECTIONAL CLEANING

(75) Inventors: Thomas Boyd, Metuchen, NJ (US); Douglas J. Hohlbein, Pennington, NJ (US); Joe Vazquez, Hamilton Township, NJ (US); Ian Nicholson, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 802 days.

(21) Appl. No.: 12/142,963

(22) Filed: Jun. 20, 2008

(65) Prior Publication Data

US 2009/0313777 A1 Dec. 24, 2009

(51) Int. Cl.

| | |
|---|---|
| ***A61B 17/24*** | (2006.01) |
| ***A46B 3/22*** | (2006.01) |
| ***A46B 9/04*** | (2006.01) |
| ***A46B 9/06*** | (2006.01) |
| ***A61H 13/00*** | (2006.01) |

(52) U.S. Cl. ..... 15/111; 15/110; 15/167.1; 15/188; 601/141; 606/161

(58) Field of Classification Search ..... 15/110, 15/111, 117, 167.1, 187, 188; 601/139–141; 606/161

See application file for complete search history.

(56) References Cited

U.S. PATENT DOCUMENTS

| | | | | |
|---|---|---|---|---|
| 871,121 A | * | 11/1907 | D'Humy | 601/135 |
| 1,125,532 A | * | 1/1915 | Himmel | 15/117 |
| 1,753,290 A | | 4/1930 | Graves | |
| 1,840,246 A | | 1/1932 | Newman | |
| 1,860,924 A | | 5/1932 | Cooke | |
| 1,928,328 A | | 9/1933 | Carpenter | |
| 1,993,662 A | | 3/1935 | Green | |
| 2,079,728 A | * | 5/1937 | Arnold | 15/110 |
| 2,244,699 A | | 6/1941 | Hosey | |

(Continued)

FOREIGN PATENT DOCUMENTS

| | | |
|---|---|---|
| FR | 2548528 | 7/1983 |

(Continued)

OTHER PUBLICATIONS

International Search Report PCT/US2008/067997 Mailed Feb. 25, 2009.

*Primary Examiner* — Mark Spisich

(74) *Attorney, Agent, or Firm* — Amy M. Fernandez

(57) ABSTRACT

An oral care implement or toothbrush 100 includes a head 104, a tooth cleaning element region 116 and a tissue cleaning element region 114. The tissue cleaning element region 114 includes a plurality of flexible, angled projections 120. The projections 120 are configured to flex from an at-rest position to a substantially flat position when the tissue cleaning element region 114 is in contact with the tongue and is pushed into the mouth. The projections 120 are also configured to flex to a substantially upright position when the tissue cleaning element region 114 is in contact with the tongue and is pulled out of the mouth. This arrangement aids in preventing debris from being pushed into the mouth and in removing debris from the mouth and tongue. The flexible projections 120 may be used in conjunction with rigid projections 122 having a generally vertical configuration to aid in removing debris from the mouth and in engaging the cheek to improve saliva production during brushing.

18 Claims, 6 Drawing Sheets

U.S. PATENT DOCUMENTS

| | | | | |
|---|---|---|---|---|
| 3,359,588 | A * | 12/1967 | Kobler | 15/110 |
| 5,810,856 | A | 9/1998 | Tveras | |
| 6,015,293 | A | 1/2000 | Rimkus | |
| 6,041,467 | A * | 3/2000 | Roberts et al. | 15/110 |
| 6,260,228 | B1 * | 7/2001 | Arroyo-Youngblood | 15/187 |
| 6,352,545 | B1 | 3/2002 | Wagner | |
| 6,408,476 | B1 | 6/2002 | Cann | |
| 6,564,416 | B1 | 5/2003 | Claire et al. | |
| 6,625,839 | B2 | 9/2003 | Fischer et al. | |
| 7,143,462 | B2 | 12/2006 | Hohlbein | |
| 7,273,327 | B2 | 9/2007 | Hohlbein et al. | |
| 2002/0019645 | A1 | 2/2002 | Fischer et al. | |
| 2003/0167582 | A1 | 9/2003 | Fischer et al. | |
| 2004/0177462 | A1 | 9/2004 | Brown, Jr. et al. | |
| 2004/0255416 | A1 | 12/2004 | Hohlbein | |
| 2005/0015907 | A1 | 1/2005 | Georgi et al. | |
| 2005/0166344 | A1 | 8/2005 | Hohlbein et al. | |
| 2005/0210612 | A1 | 9/2005 | Hohlbein et al. | |
| 2005/0235439 | A1 | 10/2005 | Braun et al. | |
| 2006/0010628 | A1 | 1/2006 | Moskovich | |
| 2006/0026784 | A1 | 2/2006 | Moskovich et al. | |
| 2006/0052806 | A1 | 3/2006 | Xi et al. | |
| 2006/0057087 | A1 | 3/2006 | Moskovich et al. | |
| 2006/0129171 | A1 | 6/2006 | Moskovich | |
| 2006/0195995 | A1 | 9/2006 | Moskovich et al. | |
| 2006/0200925 | A1 | 9/2006 | Moskovich | |
| 2006/0272112 | A9 | 12/2006 | Braun et al. | |
| 2006/0288510 | A1 | 12/2006 | Georgi et al. | |
| 2007/0101525 | A1 | 5/2007 | Hohlbein | |
| 2007/0271717 | A1 | 11/2007 | Clos et al. | |

FOREIGN PATENT DOCUMENTS

| | | | |
|---|---|---|---|
| WO | 98/08458 | A2 | 3/1998 |
| WO | 00/35314 | A1 | 6/2000 |
| WO | 0145573 | A1 | 6/2001 |
| WO | 0189344 | A2 | 11/2001 |
| WO | 2006055571 | A2 | 5/2006 |
| WO | 20006071676 | A2 | 7/2006 |

* cited by examiner

ORAL CARE IMPLEMENT HAVING TISSUE CLEANING ELEMENTS WITH DIRECTIONAL CLEANING

BACKGROUND OF THE INVENTION

The present invention pertains to an oral care implement, such as a toothbrush, with an enhanced tissue cleaner. According to the American Dental Association, a major source of bad breath in healthy people is microbial deposits on the tongue, where a bacterial coating harbors organisms and debris that contribute to bad breath. Tissue in the mouth, and especially the tongue, is a haven for the growth of micro-organisms. The papillary nature of the tongue surface creates a unique ecological site that provides an extremely large surface area, favoring the accumulation of oral bacteria. Anaerobic flora and bacteria residing on the tongue and other soft tissues in the mouth play an important role in the development of chronic bad breath commonly called halitosis. In general, the bacteria produce volatile sulfur compounds (VSC). If there is enough buildup of the sulfur compounds, the result can be lead bad breath or oral malodor.

While tongue scrapers have been used in the past, they have generally not been effective or easy to use. Further, many of these scrapers cannot easily be used to cleanse other tissue within the mouth. Notwithstanding the benefits to be gained by cleaning the tissue in the mouth, many users avoid the use of such cleansers due to a lack of comfort and/or ease of use. The present description seeks to overcome certain of these limitations and to provide new features heretofore not available.

BRIEF SUMMARY OF THE INVENTION

The invention pertains to an oral care implement or toothbrush with a configuration of tissue cleaning elements to provide enhanced cleaning of the tongue and other mouth tissue.

In one aspect of the invention, an oral care implement has a head connected to a handle. The head includes a tooth cleaning element region and a tissue cleaning element region. The tooth cleaning element region may include various bristle or other tooth cleaning element arrangements. The tissue cleaning element region includes a plurality of angled tissue cleaning projections. The tissue cleaning projections can be movable between a plurality of positions to provide directional cleaning.

In another aspect of the invention, the angled tissue cleaning projections can be configured on a portion of the head and another portion of the head can include a plurality of substantially rigid projections formed of a more rigid material than the angled tissue cleaning projections.

Other features and advantages of the invention will become apparent from the following description taken in conjunction with the following drawings.

DETAILED DESCRIPTION OF THE INVENTION

Figure 1:
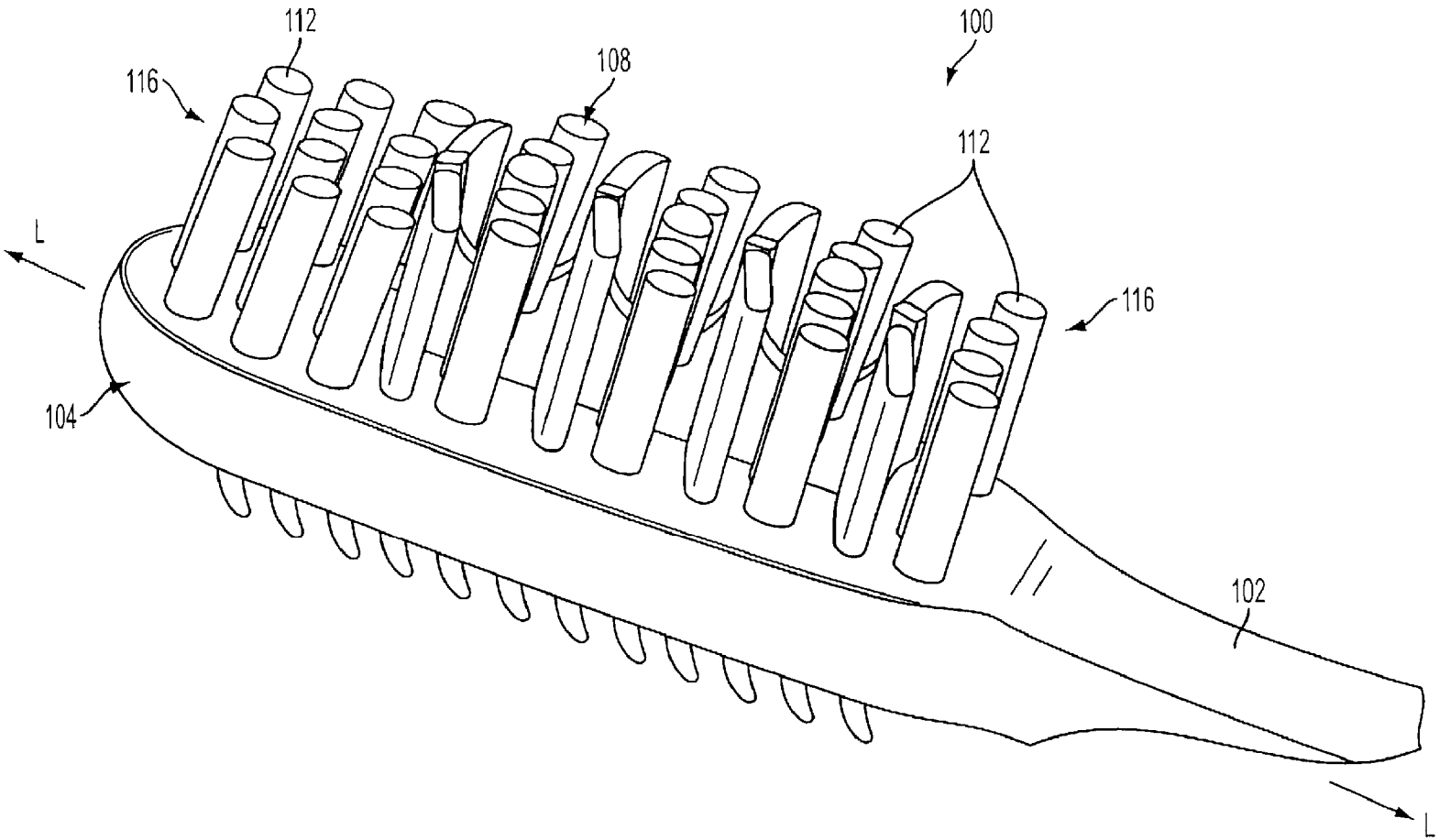
FIG. 1 is a perspective view of a toothbrush according to one or more aspects of an illustrative embodiment, a handle of the toothbrush being partially shown.

In the following description, the invention is discussed in terms of a toothbrush, but could be in the form of other oral care implements including simply a tissue cleansing implement. Further, it is understood that other embodiments may be utilized and structural and functional modifications may be made without departing from the scope of the present invention.

FIGS. 1-6 illustrate an oral care implement, or toothbrush, of the present invention, generally designated with the reference numeral 100. The toothbrush 100 generally includes a handle 102 and a head 104. The toothbrush 100 generally has a longitudinal axis L.

The handle 102 is generally an elongated member that is dimensioned for the user to readily grip and manipulate the toothbrush 100. The handle 102 may be formed of many different shapes, lengths and with a variety of constructions. The handle 102 may have a neck portion directly adjacent to the head 104. In one construction, the handle 102 is integrally formed with the head 104 although other attachment configurations are possible. In some arrangements, the handle 102 may be removable connected to the head 104.

The head 104 generally includes a first cleaning region 116 and a second cleaning region 114 and is configured for reducing oral malodor and cleaning the teeth and tissue in the mouth, such as the tongue, interior surfaces of the cheeks, lips or the gums. The first cleaning region 116 is formed on a first surface of the head 104 and may be a tooth cleaning region. The tooth cleaning region 116 includes a plurality of tooth cleaning elements 112, 108 protruding outward. The tooth cleaning elements 112, 108 may be in the form of individual bristles, tufts of bristles, and the like. It is understood that the bristles 112 are preferably made from nylon although other materials could be used. The bristles 112 also preferably have a generally circular cross-sectional shape, but could have other cross-sectional shapes as well. The bristles 112 may be similar in size, shape, height etc. Additionally or alternatively, the bristles may have varying sizes, shapes, heights, etc. In addition, the first cleaning region 116 may include elastomeric tooth cleaning members 108 instead of or in addition to the bristles 112.

The second cleaning region 114 is configured on a second surface of the head 104 and may be a tissue cleaning region. The tissue cleaning region 114 includes a plurality of tissue cleaning elements 120. The plurality of tissue cleaning elements includes generally flexible projections, which may include nubs 120. These projections 120 enable removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth, such as cheeks, gums, etc. When engaged or otherwise pulled against a tongue surface, for example, the projections 120 of the tissue cleaning region can provide for gentle engagement with the soft tissue while reaching downward into the recesses of adjacent papillae of the tongue.

The flexible projections 120 may be formed of any suitable elastomeric material, as will be discussed more fully below. The elastomeric construction of the projections 120 enables the base surface to follow the natural contours of the oral tissue surfaces, such as the tongue, cheeks, lips, and gums of a user. In addition, the projections 120 are configured to flex as needed to traverse and clean the soft tissue surfaces in the mouth along which it is moved.

In addition, the flexibility of the tissue cleaning projections 120 shown allows for directional cleaning of the tissue. That is, the projections 120 may be arranged to avoid pushing debris further into the mouth and to enhance pulling debris out of the mouth, as will be discussed more fully below. For instance, in an at-rest position, the tissue cleaning projections are configured at an angle relative to the head. When in use, the tissue cleaning projections flex in a first direction to prevent debris from being pushed into the mouth and flex in a second direction to aid in removal of debris from the mouth and tongue. For instance, when the tissue cleaning element is in contact with the tongue and is pushed into the mouth, the tissue cleaning projections will transition from the at-rest position to a substantially flat position. This arrangement aids in preventing debris from being pushed into the mouth. As the user pulls the toothbrush out of the mouth with the tooth cleaning elements engaged with the tongue, the tooth cleaning projections transition to a substantially upright arrangement to scrape the tongue and remove debris from the tongue and mouth. In some arrangements, the tissue cleaning projections will flex to a maximum upright position.

Figure 2:
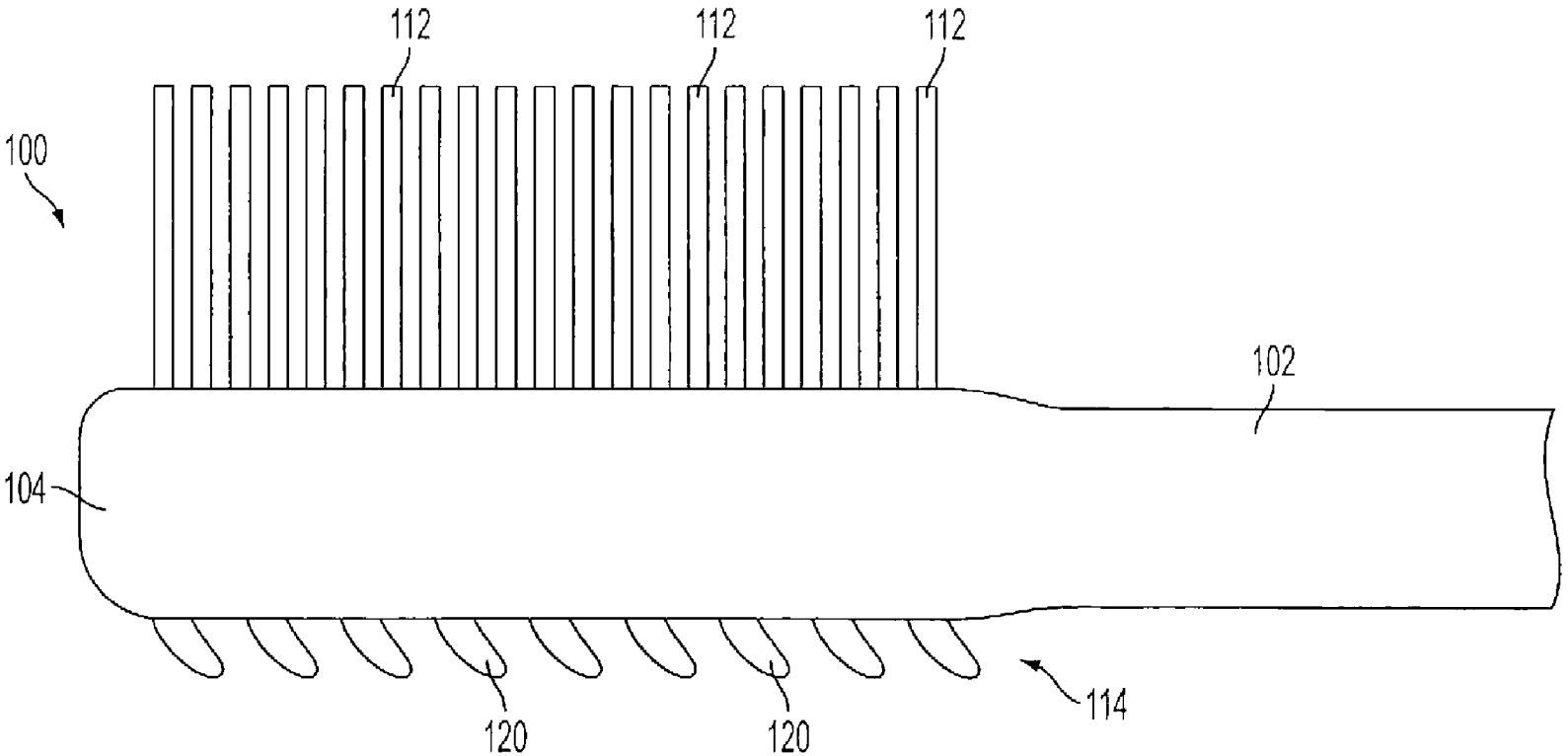
FIG. 2 is a side view of the toothbrush of FIG. 1 having tooth cleaning elements and depicting tissue cleaning projections in an at-rest position.

FIG. 2 is a side view of a toothbrush 100 showing the head 104 in a non-use position. That is, the toothbrush head 104 of FIG. 2 is not being used but rather is idle. The bristles 112 of the first cleaning region 116 are shown protruding upward from the first cleaning surface. In addition, the tissue cleaning projections 120 of the second cleaning region 114 are arranged at an angle relative to the head. For instance, in a natural, at-rest state, such as shown in FIG. 2, the projections 120 are arranged at an angle between 30° and 60° from the surface of the head 104. In one arrangement, the projections 120 may be arranged at a 45° angle from the surface of the head 104.

Figure 3A:
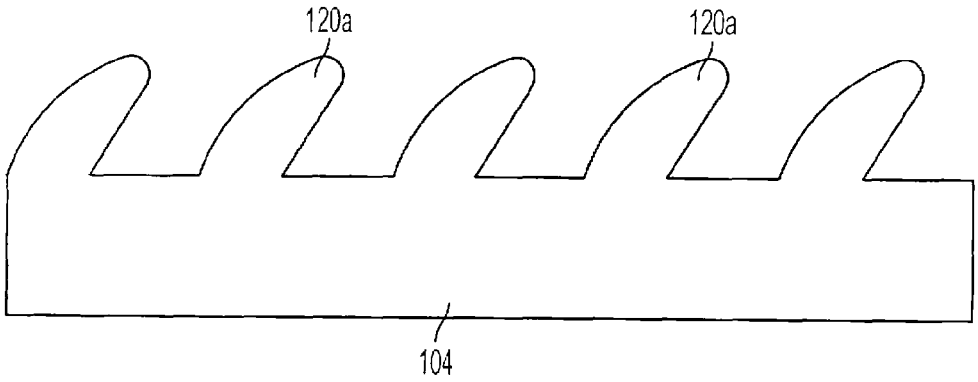
FIGS. 3A-3C illustrate various positions of the tissue cleaning projections as described herein.
Figure 3B:
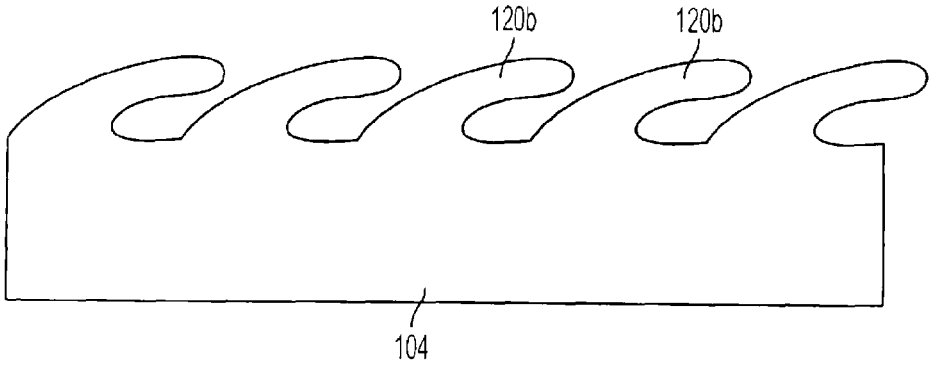
Figure 3C:
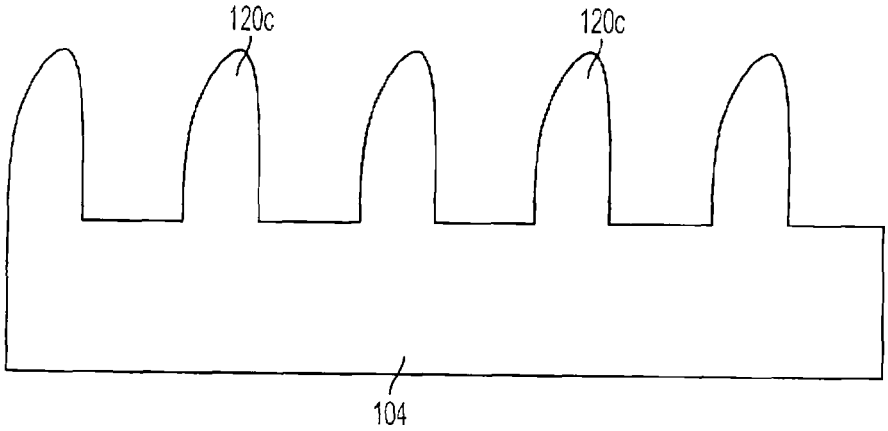

The angled arrangement of the tissue cleaning projections 120 aids in directional cleaning of the tongue and other tissue within the mouth. FIGS. 3A-3C shows a portion of the head 104 with angled projections 120 in various positions. The projections 120 are shown connected to the head 104. The tooth cleaning element region 116 and handle 102 have been removed for simplicity. As shown in FIG. 3A-3C, the angled projections 120 have three positions, at-rest (FIG. 3A), substantially flat (FIG. 3B) and substantially upright (FIG. 3C). As described above, the angled projections 120*a* of the at rest position may be generally between 30° and 60° from the surface of the head 104. In using the tissue cleaning element of the toothbrush, a user will generally insert the toothbrush 100 into the mouth and contact the tongue with the tissue cleaning projections 120. The user will then push the toothbrush 100 in a first direction, i.e., toward the rear of the mouth, scraping the tissue cleaning projections 120 along the tongue. In order to avoid pushing debris from the tongue, and the mouth in general, further into the mouth, the projections 120 will adjust from the at-rest position of the projections 120*a* to a substantially flat position of the projections 120*b*, shown in FIG. 3B. In some arrangements, the substantial flex associated with the adjustment from the at rest position to the substantially flat position may be at least 50% of the angle between the projections and the surface of the head. Moreover, the projections can lift up and loosen debris and break up biofilm as the tissue cleaning elements are pushed into the mouth, yet the substantially flat arrangement may reduce the amount of debris pushed further into the mouth. This adjustment is generally caused by the pressure of the tongue against the projections 120 and the direction of the motion of the projections 120 relative to the tongue. In the substantially flat position, at least a portion of the projections 120*b* and, in some cases all of the projections 120*b*, will be flexed in one direction to a point where they form a minimal angle with the surface of the head 104.

FIG. 3C illustrates the position of the projections 120*c* in a substantially upright position. For example, as the user pulls the toothbrush in a second direction, i.e., out of the mouth, the projections 120 will transition from the substantially flat position of projections 120*b*, through the at rest position projections 120*a* to the substantially upright position projections 120*c*. That is, the projections 120 may substantially flex from the substantially flat position to the upright position shown. In some arrangements, the substantial flex associated with this arrangement includes projections 120 that flex more than 50% of the distance from the at rest position to a maximum upright position.

In this upright position, the projections 120*c* will be configured to scrape the tongue or other tissue and remove debris from the surface being scraped, including debris loosened by the projections when in the substantially flat position.

In some arrangements, the projections 120 may not substantially flex. That is, the projections may be formed in at least one of the positions shown in FIGS. 3A-3C and may remain in that position during use. In one example, the projections 120 may have little undercut (i.e., be positioned similar to the substantially flat position) and may remain there as the tissue cleaning element scrapes the tongue. For instance, the projections will not have substantial flex, as described above. In some arrangements, generally insubstantial flex for the upright projections generally corresponds that the projection flexes/bends less than about 2-10% of the radial distance from the at rest position of the projection (as measured from the longitudinal axis of the projection) to the surface of the head of the toothbrush. Nevertheless, other valves are possible. This arrangement may aid in lifting up debris and breaking up biofilm as the tissue cleaning element is pushed into the mouth and removing debris as the tissue cleaning element is removed from the mouth.

Figure 4:
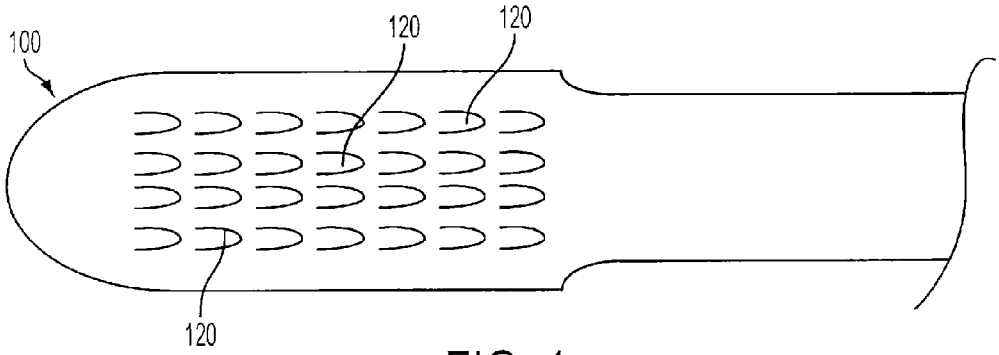
FIG. 4 is a top plan view of a toothbrush having one tissue cleaning projection arrangement.

FIG. 4 illustrates one arrangement of the head 104 showing the tissue cleaning region 114. The tissue cleaning region 114 includes a plurality of tissue cleaning projections 120. The tissue cleaning projections 120 may be formed of any suitable material, such as a thermoplastic elastomer (TPE) or linear low density polyethylene (LLDPE). In addition, the projections 120 may be formed of TPEs having varying hardness values.

As shown in FIG. 4, the plurality of tissue cleaning projections 120 may be arranged in rows. In the arrangement shown, the rows are substantially parallel to each other. In some arrangements, the projections 120 may be arranged between 0.2 and 1.5 mm apart. In one particular arrangement, the projections 120 may be approximately 0.3 mm apart. In addition, the projections 120 are generally aligned with each other, both longitudinally and laterally. This arrangement may aid in cleaning the tissue cleaning region and may aid in removing debris from the tissue cleaning region.

Figure 5A:
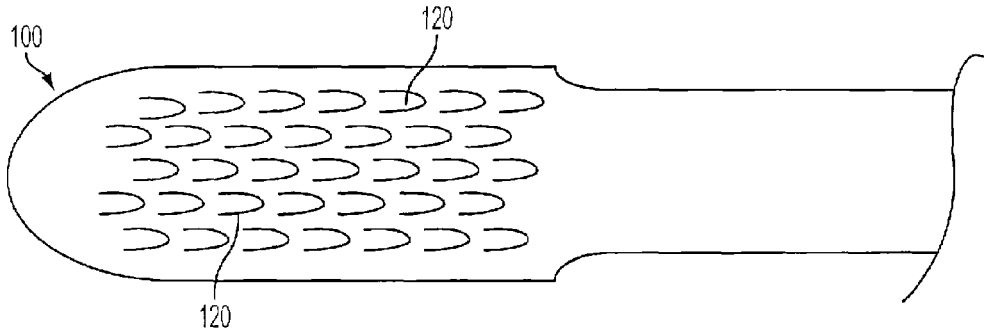
FIG. 5A is a top plan view of a toothbrush having an alternate tissue cleaning projection arrangement.

FIG. 5A illustrates an alternate tissue cleaning projection configuration. In the arrangement shown, the tissue cleaning projections 120 are arranged in rows extending longitudinally along the head 104 of the toothbrush. The rows of projections 120 are offset. Alternating rows of projections 120 begin and end at different points in order to stagger the position of the projections 120. This offset arrangement may aid in allowing more projections 120 to be arranged on the head 104 and in providing a more compact cleaning field.

Figure 5B:
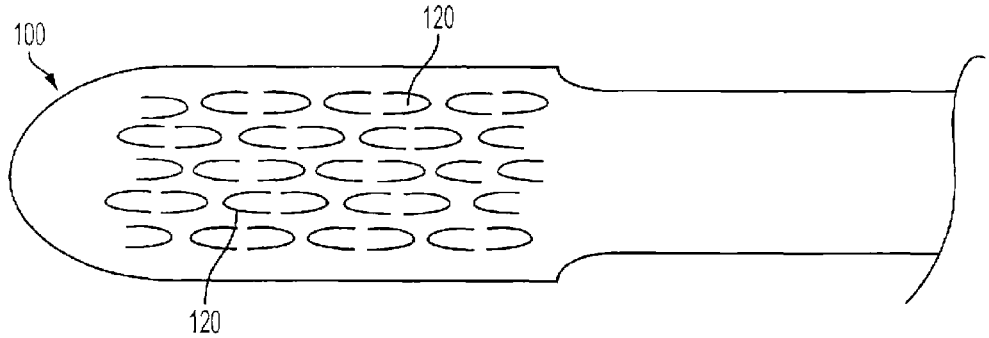
FIG. 5B is a top plan view of a toothbrush having yet another alternate tissue cleaning projection arrangement.
Figure 5C:
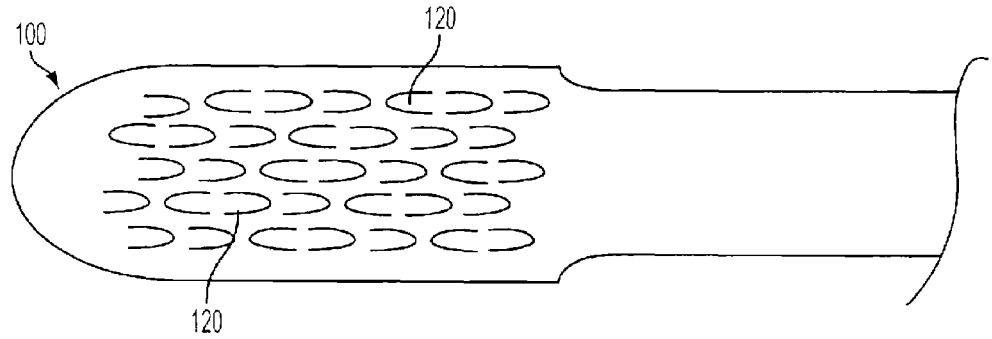
FIG. 5C is a top plan view of a toothbrush having still another alternate tissue cleaning projection arrangement.

FIG. 5B illustrates yet another alternate tissue cleaning projection configuration. As shown, the tissue cleaning projections 120 are arranged in rows extending longitudinally along the head 104 of the toothbrush. The projections 120 including projections extending in the first direction and an opposite direction. This arrangement allows for directional cleaning when the toothbrush is moved into the mouth and out of the mouth, thereby lifting and removing debris in both the inward and outward strokes. FIG. 5C illustrates an alternate arrangement wherein more projections 120 are positioned in the first direction than the second direction to allow for more lifting of debris at the toothbrush is pushed into the mouth but more scraping and removal action as the toothbrush is pulled out of the mouth.

Figure 5D:
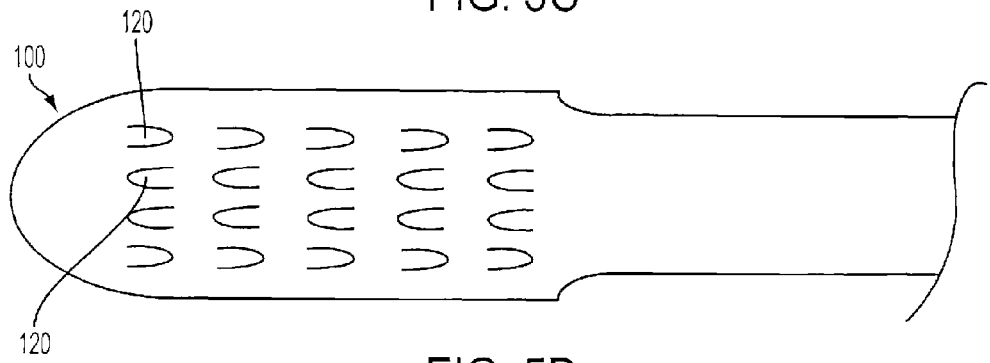
FIG. 5D is a top plan view of a toothbrush having still another alternate tissue cleaning projection arrangement.

FIG. 5D illustrates another alternate tissue configuration. In the arrangement shown, the projections 120 nearest the longitudinal centerline of the toothbrush 100 extend in the first direction. The projections 120 nearest the perimeter, or outer region, of the toothbrush 100 extend in the opposite direction. This arrangement provides directional cleaning when the toothbrush 100 is moved into the mouth and out of the mouth, thereby lifting and removing debris in both the inward and outward strokes.

Figure 6A:
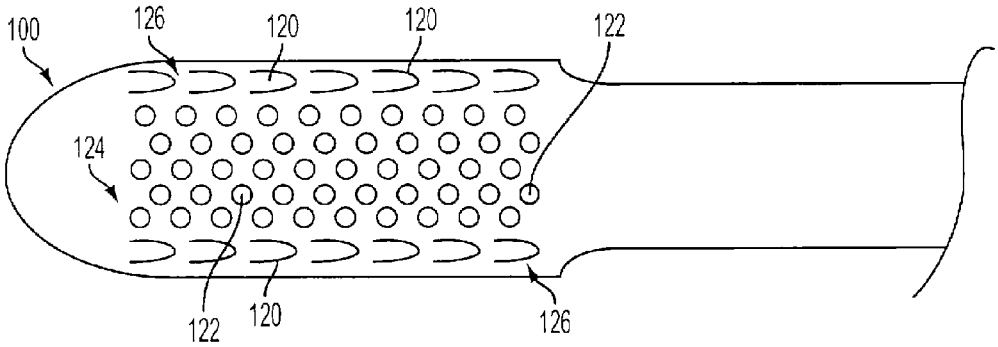
FIG. 6A is a top plan view of a toothbrush having yet another tissue cleaning projection arrangement.

In addition to the arrangements discussed above, the tissue cleaning projections 120 may also be used in conjunction with more conventional tissue cleaning elements. For instance, the head 104 may include a plurality of angled tissue cleaning projections 120, as described above. In addition, the head 104 may also include regions having a plurality of substantially vertically arranged tissue cleaning elements 122. FIG. 6A illustrates one example combination projection arrangement. In the arrangement shown, the head 104 includes a central tissue cleaning region 124. This central region 124 includes a plurality of substantially vertical projections 122 as known in the art. The vertical projections 122 may be arranged in rows and may be aligned longitudinally and laterally or may be offset or staggered. In addition, the vertical projections 122 may be substantially rigid to maintain the vertical position during use. In addition to the central tissue cleaning region 124, the head 104 includes two outer tissue cleaning regions 126. These outer regions 126 are arranged adjacent to the central cleaning region 124 and along the periphery of the head 104. The outer regions 126 generally include a plurality of angled projections 120, such as those described above with respect to FIGS. 1-5. The angled projections 120 are flexible and may aid in preventing debris from being pushed into the mouth, while aiding in the removal of debris from the tongue and mouth.

Figure 6B:
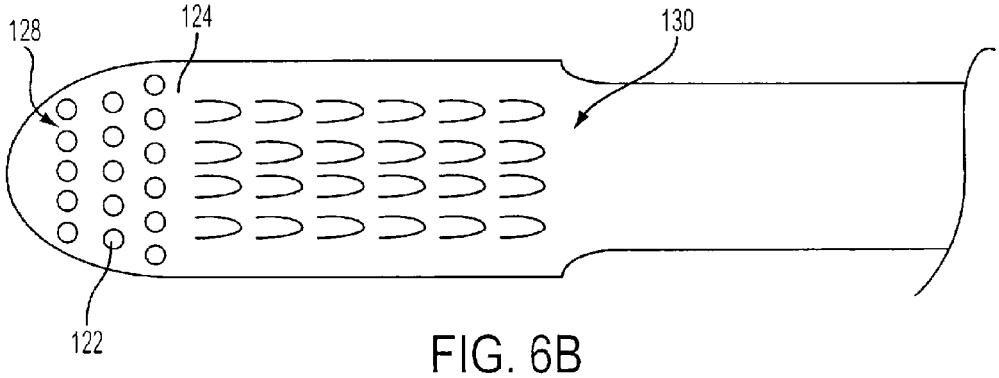
FIG. 6B is a top plan view of a toothbrush having yet another tissue cleaning projection arrangement.

FIG. 6B illustrates another example combination projection arrangement. In the arrangement shown, the head 104 includes a distal cleaning portion 128 and a proximal cleaning portion 130. The distal cleaning portion includes a plurality of substantially vertical projections 122. The vertical projections 122 may be in rows and may be aligned longitudinally and laterally or may be offset or staggered. The vertical projections 122 may also be arranged in a circular pattern. The vertical projections may be substantially rigid to maintain the vertical position during use. The proximal cleaning portion 130 includes a plurality of angled tissue cleaning projections 120.

In addition to providing enhanced tongue cleaning, the combination of tissue cleaning elements shown in FIGS. 6A and 6B may also aid in engagement of the cheek during brushing. For instance, the angled tissue cleaning projections 120 may provide limited engagement of the cheek during brushing. However, the combination of the angled tissue cleaning projections 120 with the substantially rigid, vertical projections 122, may engage the cheek during brushing and may stimulate saliva production on the cheek to aid in cleaning the mouth. The vertical projections 122 can also loosen debris that can be scraped by the angled projections when acting as scrapers.

Further, in the arrangement of FIGS. 6A and 6B, the vertical projections 122 may aid in removal of debris loosened by the angled projections 120. For instance, as the toothbrush is pushed into the mouth the angled projections 120 may loosen debris. In addition, as the toothbrush is pulled out of the mouth, both the angled projections 120 and the vertical projections 122 will scrape the surface of the tissue to remove the debris that was loosened.

Figure 7:
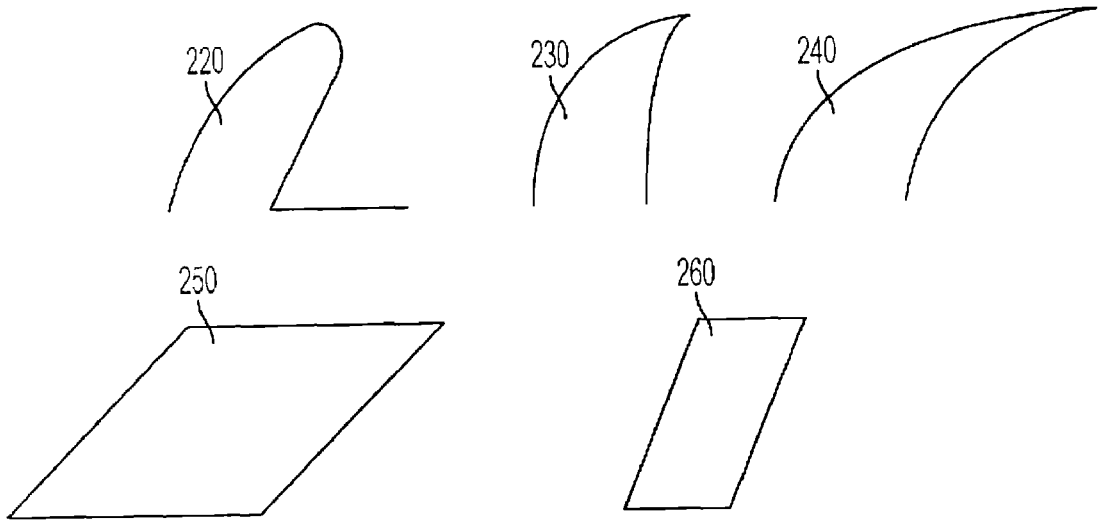
FIG. 7 is a side view of various arrangements of tissue cleaning elements according to aspects described herein.

With further reference to FIGS. 1-5, the flexible angled projections 120 may be substantially the same size and shape throughout the tissue cleaning region 114. In some examples, the flexible, angled projections 120 may include projections 120 of varying heights, diameters, and the like. In addition, FIGS. 1-6 generally illustrate the tissue cleaning projections as nubs. Additionally or alternatively, the tissue cleaning projections may include a hook shape. FIG. 7 illustrates various configurations of tissue cleaning projections that may be used. Projection 220 depicts the general nub configuration that may be used. Additionally or alternatively, the projection may have a hook shaped end, such as projection 230. Projection 240 illustrates yet another configuration having a more substantial hook shape. Various shapes and configurations may be used with the tissue cleaning projections discussed herein, such as ridges, bumps, walls (similar to projections 250 and 260) and the like.

In addition, in arrangements such as shown in FIG. 6, the plurality of rigid projections 122 may also include rigid projections 122 of varying sizes, heights, diameters, and the like.

The toothbrush 100 can be formed using a variety of manufacturing processes. Components of the toothbrushes 100 can be individually formed and subsequently connected. For instance, the tooth cleaning elements of the toothbrush 100 may be joined via anchor free tufting (AFT). In the AFT toothbrush brush making process, described in detail in U.S. Pat. No. 6,779,851, nylon is fed into a pre-molded plate that can be made from any thermoplastic or elastomer material or combination thereof. This nylon may be processed into bristle tufts of various sizes and shapes. The non-use or proximal end of the nylon is heated and melted to retain the nylon in the brush head. The head plate may then be ultrasonically welded to a pre-molded handle that has a peripheral wall or frame on which the head plate will rest and become fused to the handle. In other methods, the head can be formed having an opening wherein the tooth cleaning elements are injection-molded in a further process step through the opening in the head.

The tissue cleaning projections 120 may be formed in a variety of ways. For instance, the tissue cleaning region 114 may be integrally molded into the head 104. Alternatively, the tissue cleaning region 114 may be formed as a separate piece from the head 104 and connected to the head 104 using known methods of attachment.

The inventive aspects may be practiced for a manual toothbrush or a powered toothbrush. In operation, the previously described features, individually and/or in any combination, improves performance of tissue cleaning elements. These advantages are also achieved by the tooth cleaning elements and the synergistic effects. While the various features of the toothbrush 100 work together to achieve the advantages previously described, it is recognized that individual features and sub-combinations of these features can be used to obtain some of the aforementioned advantages without the necessity to adopt all of these features. It is understood that designations such as "first" and "second" are for illustrative purposes and can be interchanged.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

We claim:

1. An oral care implement, comprising:

a head; and a tissue cleaning element disposed on the head, the tissue cleaning element including a plurality of angled projections formed of a thermoplastic elastomer, the plurality of angled projections having a first position and being configured to flex from the first position to a second position and to a third position, the second position being substantially upright and the third position being substantially flat, wherein the plurality of angled projection further comprise angled projections having a hook shaped distal end formed by a first surface of the angled projection and a second surface of the angled projection, the first surface and the second surface curving in the same direction.

2. The oral care implement of claim 1, wherein the angled projections include nubs.

3. The oral care implement of claim 1, wherein the angled projections are between 30° and 60° from the head of the oral care implement when in the first position.

4. The oral care implement of claim 1, wherein the angled projections are between 0.1 mm and 0.5 mm apart.

5. The oral care implement of claim 1, wherein the angled projections flex from the first position to the third position when the oral care implement contacts the mouth in a first direction and the angled projections flex to the second position when the oral care implement contacts the mouth in a second direction.

6. The oral care implement of claim 5, wherein the first direction is into a mouth of a user and the second direction is out of the mouth of a user.

7. The oral care implement of claim 1, wherein the angled projections are arranged in linear rows.

8. The oral care implement of claim 1, wherein the angled projections are aligned longitudinally and laterally.

9. The oral care implement of claim 1, wherein the angled projections are arranged in linear rows and each linear row is offset from an adjacent linear row.

10. The oral care implement of claim 1, wherein a first portion of the angled projections flex from the first position to the second position while a second portion of the angled projections flex from the first position to the third position.

11. The oral care implement of claim 1, wherein the angled projections are substantially flexible.

12. An oral care implement, comprising:

a head including:

a tooth cleaning element region; and a tissue cleaning element region, the tissue cleaning element region including a plurality of angled tissue cleaning projections, the tissue cleaning projections being configured to flex between:

a first angled position when at rest;

a second angled position when the tissue cleaning element contacts a tongue in a first direction, the second angled position being substantially upright; and a third angled position when the tissue cleaning element contacts the tongue in a second direction, the third angled position being substantially flat, wherein each angled tissue cleaning projection comprises a hook shaped distal end formed by a first surface of the angled tissue cleaning projection and a second surface of the angled tissue cleaning projection, the first surface and the second surface curving in the same direction.

13. The oral care implement of claim 12, wherein the first direction is opposite the second direction.

14. The oral care implement of claim 13, wherein the second direction is directed away from of a mouth of user and the first direction is directed towards the mouth.

15. The oral care implement of claim 12, wherein the tissue cleaning element region is positioned on a first surface of the head and the tooth cleaning element region is positioned on a second surface of the head, the second surface being opposite the first surface.

16. The oral care implement of claim 12, wherein the projections of the first angled position are angled between 30° and 60° from the head.

17. The oral care implement of claim 12, wherein the head is removably connected to a handle.

18. The oral care implement of claim 12, wherein the tissue cleaning projections are thermoplastic elastomer members.

* * * * *